US010876815B1

(12) United States Patent
Wingfield

(10) Patent No.: US 10,876,815 B1
(45) Date of Patent: Dec. 29, 2020

(54) OPTIC MOUNTING SYSTEM

(71) Applicant: William E. Wingfield, El Paso, TX (US)

(72) Inventor: William E. Wingfield, El Paso, TX (US)

( * ) Notice: Subject to any disclaimer, the term of this patent is extended or adjusted under 35 U.S.C. 154(b) by 0 days.

(21) Appl. No.: 16/882,797

(22) Filed: May 26, 2020

Related U.S. Application Data

(60) Provisional application No. 62/875,559, filed on Jul. 18, 2019.

(51) Int. Cl.
*F41G 1/16* (2006.01)
*F41G 1/30* (2006.01)

(52) U.S. Cl.
CPC . *F41G 1/16* (2013.01); *F41G 1/30* (2013.01)

(58) Field of Classification Search
USPC ..... 42/127
See application file for complete search history.

(56) References Cited

U.S. PATENT DOCUMENTS

| | | | | |
|---|---|---|---|---|
| 4,628,611 | A * | 12/1986 | Ruffino | F41G 1/16 42/137 |
| 9,062,936 | B2 * | 6/2015 | Zimmer | F41G 11/003 |
| 9,506,726 | B2 * | 11/2016 | Wolf | F41G 1/26 |
| 10,024,628 | B2 * | 7/2018 | Toner | F41G 1/16 |
| 10,782,099 | B2 * | 9/2020 | Zimmer | F41G 11/001 |
| 2017/0059277 | A1 * | 3/2017 | Justice | F41G 11/003 |

* cited by examiner

*Primary Examiner* — Reginald S Tillman, Jr.
(74) *Attorney, Agent, or Firm* — Shaddock Law Group, PC

(57) ABSTRACT

An optic mounting system, including at least some of a slide having a slide optic recess formed therein; a pair of slide insert recesses formed in opposing sides of the slide, wherein each slide insert recess is formed at least partially below the slide optic recess, wherein one or more internally threaded slide insert recess apertures is formed in each slide insert recess; and a pair of slide inserts, wherein each slide insert is positioned within a corresponding slide insert recess, wherein at least one insert fastener aperture is formed through the slide insert, wherein each insert fastener aperture is positioned so as to be aligned with an internally threaded slide insert recess aperture, and wherein at least one internally threaded optic fastener aperture is formed through a top side of each slide insert.

20 Claims, 7 Drawing Sheets

OPTIC MOUNTING SYSTEM

A CROSS-REFERENCE TO RELATED APPLICATIONS

This patent application claims the benefit of U.S. Patent Application No. 62/875,559, filed Jul. 18, 2019, the disclosure of which is incorporated herein in its entirety by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE PRESENT DISCLOSURE

1. Field of the Present Disclosure

The present disclosure relates generally to the field of firearms. More specifically, the present disclosure relates to an optic mounting system or a holographic image optic mounting system for firearms.

2. Description of Related Art

In the custom pistol market, certain shooters want to mount a holographic image optic or other optical devices on the slide of their pistol. There are a number of optics out there and hundreds of pistol models that might be chosen to mount to. A few exemplary, nonlimiting optics that may be mounted using the systems and methods of the present disclosure are the Trijicon® Ruggedized Miniature Reflex ("RMR®"), the Trijicon® Specialized Reflex Optic ("SRO®"), and the Holosun 507C. While these are a few examples, any optic having a similarly sized footprint will work with the systems and methods of the present disclosure. Typically, the shooter wants the optic mounted as low on the pistol as possible. Thus, the optic is mounted within a slide optic recess milled into a top portion of the slide.

If the pistol slide does not already include a slide optic recess, a custom fitted inlet, depression, or recess must be milled or machined into the slide, for the optic to be fitted at least partially within. Once the slide optic recess is formed in the slide, drilled, and tapped apertures are typically formed within the slide optic recess, so that the optic can be attached or coupled, via threaded fasteners, within the slide optic recess.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE PRESENT DISCLOSURE

However, depending upon the width of the top portion of a pistol slide, it is not always possible to machine a slide optic recess into the top portion of the pistol slide and have sufficient width for the optic mounting screws or fasteners. The width of the upper portion of the pistol slide is a limiting factor in mounting optics on slides that have a narrow width dimension or have tapered sides leading to a narrower top portion when compared to the base of the slide. For example, the upper portion of the pistol slide of CZ pistols so narrow that the optic mounting screws or fasteners will just barely break through the outside wall of the slide if machined using traditional techniques.

In some situations, the narrow slide is machined and an adapter plate is mounted to the slide. The optic is then mounted to the adapter plate. While this solution does allow an optic to ultimately be mounted to a narrow slide, this potential solution has a number of drawbacks. For example, because the solution requires inclusion of an adapter plate, there is an inherent raising of the optic on the slide.

This is not ideal. Furthermore, there is the additional weight and bulk of the adapter plate. Many shooters may wish to have this modification performed to reduce the overall weight of the slide and/or pistol. Additionally, the adapter plates are a significant additional cost.

The present disclosure comprises various components, elements, and/or embodiments of an optic mounting system that provides a way to mount and optic atop a narrow slide, without an adapter plate. The systems and/or methods of the present disclosure are sometimes referred to as a Red Dot Optic Mounting System or "RDOMS".

The systems and methods of the optic mounting system of the present disclosure comprise milling a slide optic recess into the slide. In various exemplary embodiments, the slide optic recess is milled to a lowest practical depth, without interfering with the operation of the internal pistol slide mechanisms. A receiver pocket or slide insert recess is then milled into each side of the slide. The slide insert recesses are positioned relative to the positioning of the slide optic recess milled for the optic.

Once appropriately formed, the slide inserts are inserted into the slide insert recesses milled into each side of the slide.

Once the slide inserts are appropriately inserted into the slide insert recesses, the slide may optionally be milled one more time with the slide inserts in place. During this milling procedure, if included, the slide inserts, which have effectively added width to the slide at the optic's mounting points, are drilled, tapped, and fitted flush to the floor of the slide optic recess for a matched fit and finish.

The present disclosure comprises various components, elements, and/or embodiments of an optic mounting system that provides a slide having a slide optic recess formed therein; a pair of slide insert recesses formed in opposing sides of said slide, wherein each slide insert recess is formed at least partially below said slide optic recess, wherein one or more internally threaded slide insert recess apertures is formed in each slide insert recess; and a pair of slide inserts, wherein each slide insert is positioned within a corresponding slide insert recess, wherein at least one insert fastener aperture is formed through each said slide insert, wherein each insert fastener aperture is positioned so as to be aligned with an internally threaded slide insert recess aperture, and wherein at least one internally threaded optic fastener aperture is formed through a top side of each slide insert.

In various exemplary embodiments, the slide optic recess is formed so as to allow a desired optic to be attached, coupled, or otherwise mounted within at least a portion of said slide optic recess.

In various exemplary embodiments, an alignment boss extends from a portion of the top side of each said slide insert around at least a portion of each optic fastener aperture, and wherein said alignment bosses extend above at least a portion of said slide optic recess. Optionally, each alignment boss extends above a planar surface of said slide optic recess.

In various exemplary embodiments, each slide insert recess aperture is formed substantially perpendicular to a longitudinal axis of said slide.

In various exemplary embodiments, each slide insert is substantially cuboidal, when viewed from an outer side of the said slide insert.

In various exemplary embodiments, each slide insert is substantially oval, oblong, triangular, square, rectangular, hexagonal, or octagonal, when viewed from an outer side of the said slide insert.

In various exemplary embodiments, each insert fastener aperture includes a counterbore.

In various exemplary embodiments, at least 4 corners of said slide inserts are radiused and wherein 4 corresponding corners of said slide insert recesses are appropriately radiused to receive said corresponding corners of said slide insert.

In various exemplary embodiments, a fit between portions of said slide insert recess and portions of said slide insert is an interference fit.

In various exemplary, nonlimiting embodiments, the present disclosure comprises an optic mounting system, having at least some of a slide having a slide optic recess formed therein, wherein said slide optic recess extends from a top side of said slide; slide insert recesses formed in opposing side portions of said slide, wherein each slide insert recess is formed at least partially below said slide optic recess, wherein one or more internally threaded slide insert recess apertures is formed in each slide insert recess; and a pair of slide inserts, wherein each slide insert is positioned within a corresponding slide insert recess, wherein at least one insert fastener aperture is formed through each said slide insert, wherein each insert fastener aperture is positioned so as to be aligned with an internally threaded slide insert recess aperture, wherein at least one internally threaded optic fastener aperture is formed through a top side of each slide insert, wherein an alignment boss extends from a portion of the top side of each said slide insert around at least a portion of each optic fastener aperture, and wherein said alignment bosses extend above at least a portion of said slide optic recess.

In various exemplary embodiments, said slide optic recess is formed so as to allow a desired optic to be attached, coupled, or otherwise mounted within at least a portion of said slide optic recess.

In various exemplary embodiments, each slide insert recess aperture is formed substantially perpendicular to a longitudinal axis of said slide.

In various exemplary embodiments, each slide insert is substantially cuboidal, when viewed from an outer side of the said slide insert.

In various exemplary embodiments, each insert fastener aperture includes a counterbore.

In various exemplary embodiments, each alignment boss extends above a planar surface of said slide optic recess.

In various exemplary embodiments, a fit between portions of said slide insert recess and portions of said slide insert is an interference fit.

In various exemplary, nonlimiting embodiments, the present disclosure comprises an optic mounting system, having at least some of a slide having a slide optic recess formed therein, wherein said slide optic recess extends from a top side of said slide and includes a substantially planar surface; slide insert recesses formed in opposing side portions of said slide, wherein each slide insert recess is formed at least partially below said slide optic recess; and a slide insert positioned within each slide insert recess, wherein at least one internally threaded optic fastener aperture is formed through a top side of each slide insert, wherein an alignment boss extends from a portion of the top side of each said slide insert around at least a portion of each optic fastener aperture, and wherein said alignment bosses extend above at least a portion of said slide optic recess.

In various exemplary embodiments, the slide optic recess is formed so as to allow a desired optic to be attached, coupled, or otherwise mounted within at least a portion of the slide optic recess.

In various exemplary embodiments, each slide insert recess aperture is formed substantially perpendicular to a longitudinal axis of the slide.

In various exemplary embodiments, each slide insert is generally cuboidal.

In various exemplary embodiments, each insert fastener aperture includes a counterbore.

In various exemplary embodiments at least 4 corners of the slide inserts are radiused and wherein 4 corresponding corners of the slide insert recesses are appropriately radiused to receive the corresponding corners of the slide insert.

In various exemplary embodiments, the optic mounting system includes an alignment boss that extends from a portion of the top side of the slide insert, above a planar surface of the slide optic recess.

In various exemplary embodiments, a fit between portions of the slide insert recess and portions of the slide insert is an interference fit.

Accordingly, the present disclosure provides an optic mounting system that allows an optic to be mounted to a slide without an adapter plate.

The present disclosure separately and optionally provides an optic mounting system that allows an optic to be mounted to a comparatively narrower portion of a slide.

The present disclosure separately and optionally provides an optic mounting system that does not add substantial weight to a pistol slide, as compared to utilization of an adapter plate.

The present disclosure separately and optionally provides an optic mounting system that allows an optic to be mounted in a lower position relative to a pistol slide, as compared to utilization of an adapter plate.

The present disclosure separately and optionally provides an optic mounting system that allows an optic to be retrofitted to a pistol slide.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures.

While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the present disclosure are disclosed herein; however, it is to be understood that the disclosed embodiments are merely exemplary of the present disclosure that may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the present disclosure will be described in detail, with reference to the following figures, wherein like reference numerals refer to like parts throughout the several views, and wherein.

DETAILED DESCRIPTION OF THE PRESENT DISCLOSURE

Figure 1:
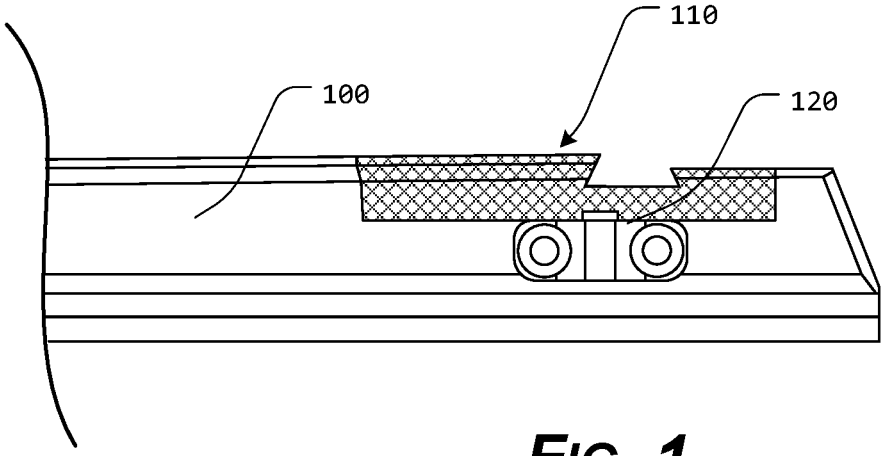
FIG. 1 illustrates a side view of certain exemplary components of an optic mounting system, according to the present disclosure.
Figure 2:
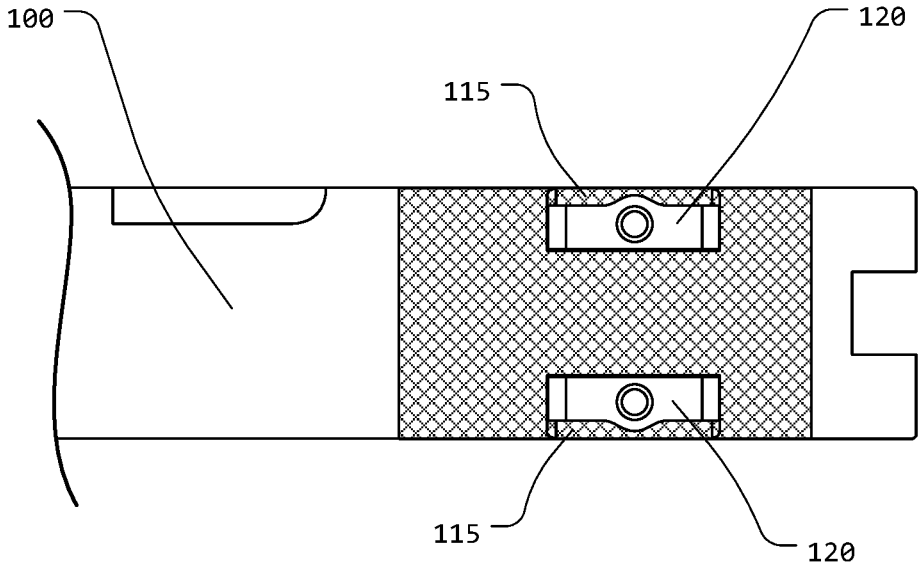
FIG. 2 illustrates a top view of certain exemplary components of an optic mounting system, according to the present disclosure.
Figure 3:
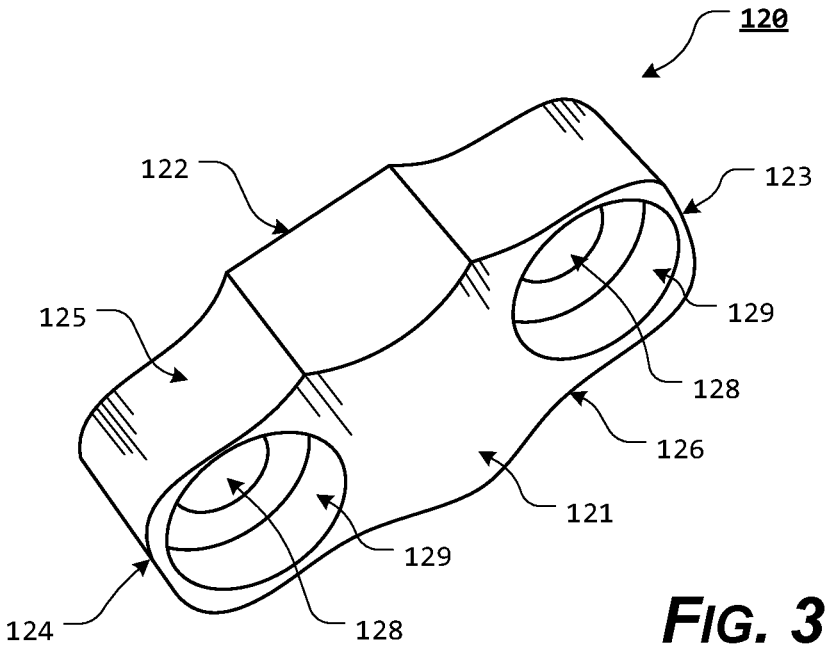
FIG. 3 illustrates an upper perspective view of an exemplary embodiment of a slide insert, according to the present disclosure.
Figure 4:
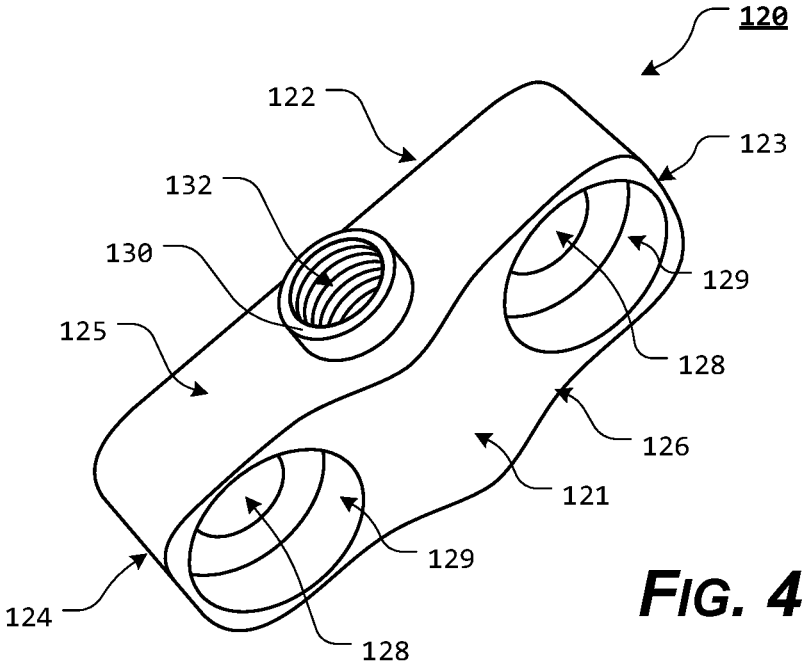
FIG. 4 illustrates an upper perspective view of an exemplary embodiment of a slide insert, according to the present disclosure.

For simplicity and clarification, the design factors and operating principles of the optic mounting system according to the present disclosure are explained with reference to various exemplary embodiments of an optic mounting system according to the present disclosure. The basic explanation of the design factors and operating principles of the suppressor heat shield and/or the optic mounting system is applicable for the understanding, design, and operation of the present disclosure. It should be appreciated that the present disclosure can be adapted to many applications where an optic can be mounted to a firearm or other device.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the elements such terms describe. Thus, these terms are not necessarily intended to indicate temporal or other prioritization of such elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "optic", "optic mounting system", "pistol slide", "slide", "slide insert", and "pistol" are used for basic explanation and understanding of the operation of the systems, methods, and apparatuses of the present disclosure. Therefore, the terms "optic", "optic mounting system", "pistol slide", "slide", "slide insert", and "pistol" are not to be construed as limiting the systems, methods, and apparatuses of the present disclosure. Thus, for example, the term "optic" is to be understood to broadly include any optical or other accessory or device capable of being attached or coupled to an object, the term "pistol" is to be understood to broadly include any firearm or other device, and the term "slide" is to be understood to broadly include any portion of a firearm or other device upon which it is desirable to mount an optic.

For simplicity and clarification, the optic mounting system of the present disclosure will be described as being used in conjunction with a pistol slide of a pistol. However, it should be appreciated that these are merely exemplary embodiments of the optic mounting system and are not to be construed as limiting the present disclosure. Additionally, the present disclosure is discussed as being utilized in conjunction with a red dot optic or a holographic image optic. It should be appreciated that these are merely examples and it is to be understood that the systems and methods of the present disclosure can be used in connection with any presently known or later developed red dot optic, holographic image optic, holographic sight, prism sight, reflex sight, or other sight or optic. Thus, one of ordinary skill in the art will readily understand that the optic mounting system of the present disclosure can be adapted to many applications in which any sight or optic can be mounted to a firearm or other device.

Turning now to the drawing FIGS., FIGS. 1-13 illustrates certain exemplary elements and/or components of an exemplary optic mounting system, according to the present disclosure.

The elements and/or components of the optic mounting system are shown and described as being used in conjunction with one or more exemplary embodiments of a slide of a semi-automatic type pistol. A more detailed explanation of the components and operation of a semi-automatic pistol and slide are not provided herein because such components are commercially available and/or such background information will be known to one of ordinary skill in the art. Therefore, it is believed that the level of description provided herein is sufficient to enable one of ordinary skill in the art to understand and practice the present disclosure, as described.

FIGS. 1-13 illustrate certain elements and/or aspects of an exemplary embodiment of an optic mounting system, according to the present disclosure. As illustrated in FIGS. 1-13, the optic mounting system incorporates at least some of a slide optic recess 110 formed in a slide 100, a pair of slide insert recesses 115 formed in the slide 100, and a pair of slide inserts 120.

In order to utilize the optic mounting system of the present disclosure, a slide 100 must be provided with an appropriate slide optic recess 110 formed therein. In certain exemplary embodiments, the slide optic recess 110 may be formed as part of the manufacturing process of the slide 100. Alternatively, if an appropriate slide optic recess 110 is not already formed in the slide 100, an appropriate slide optic recess 110 can be machined or milled into the slide 100, as illustrated most clearly in FIGS. 5-9. Generally, the slide optic recess 110 is formed so as to allow a desired optic to be attached, coupled, or otherwise mounted within at least a portion of the slide optic recess 110.

Generally, in order to provide the lowest possible mounting for the attached or coupled optic, the slide optic recess 110 is milled to a lowest practical depth relative to the slide 100. The lowest practical depth relative to the slide 100 will vary from slide to slide but is typically a depth that allows for mounting of the optic, without interfering with the operation of the internal pistol slide apertures or mechanisms, such as, for example, the firing pin aperture, the extractor recess, etc.

Figure 7:
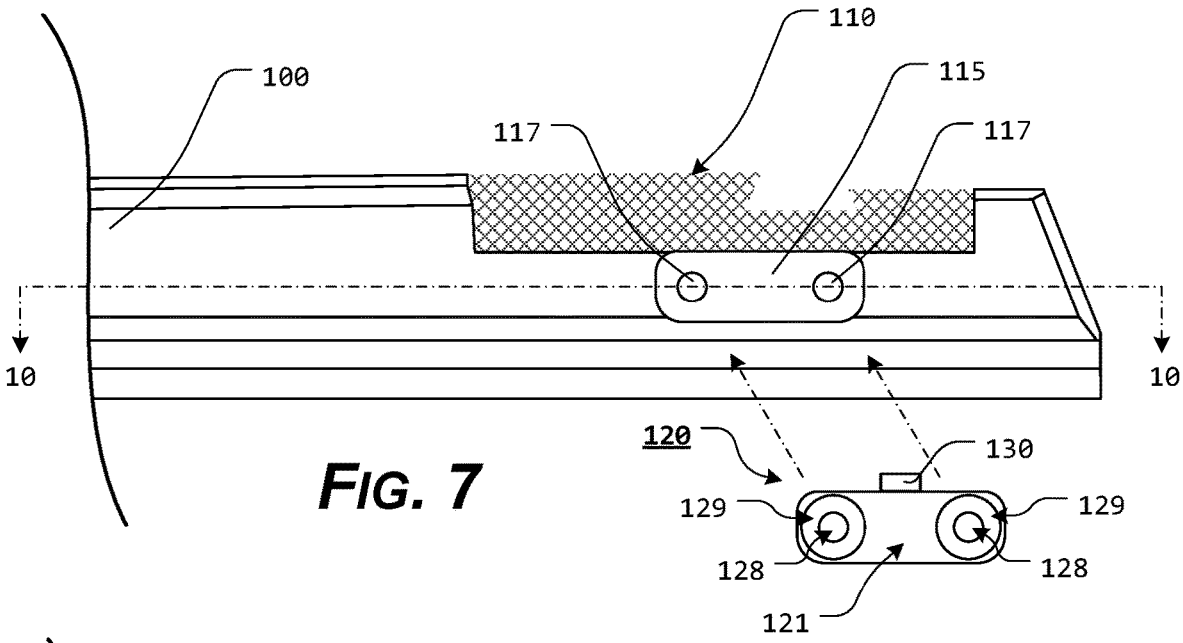
FIG. 7 illustrates a side view of an exemplary embodiment of a slide having a slide optic recess and a slide insert recess formed therein, according to the present disclosure.
Figure 8:
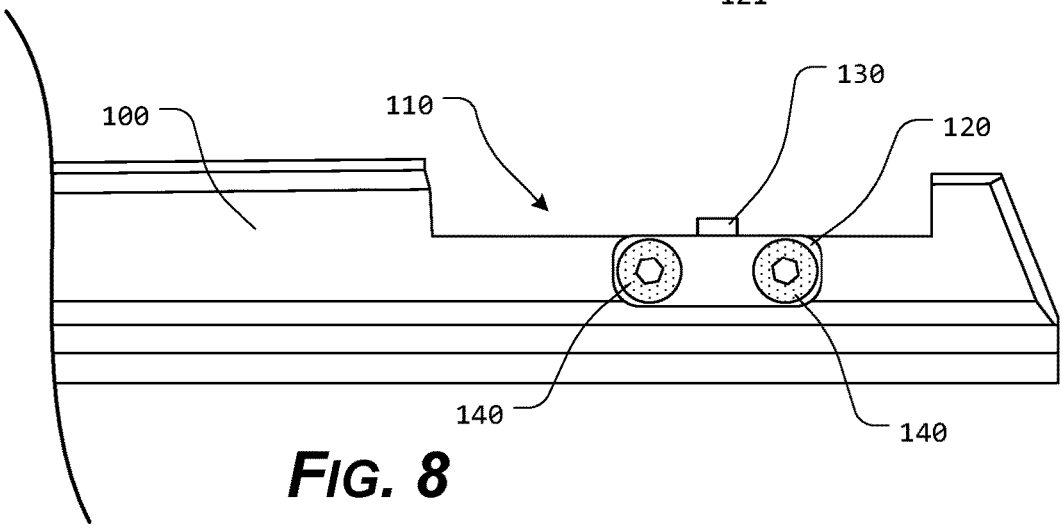
FIG. 8 illustrates a side view of an exemplary embodiment of a slide having a slide optic recess and a slide insert recess formed therein, wherein a slide insert is attached or coupled within the slide insert recess, according to the present disclosure.
Figure 9:
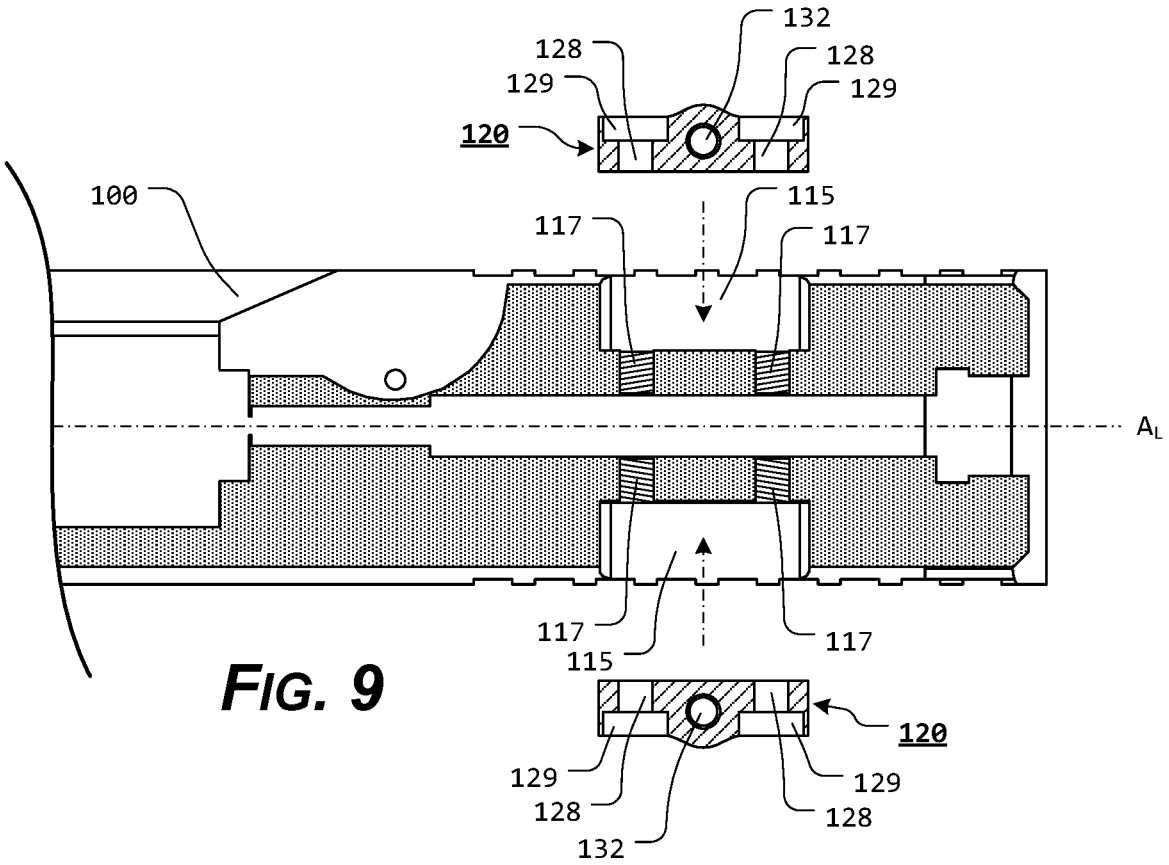
FIG. 9 illustrates a partial cutaway view, taken along line 10-10 of FIG. 8, wherein exemplary slide inserts are aligned with the exemplary slide insert recesses, according to the present disclosure.
Figure 10:
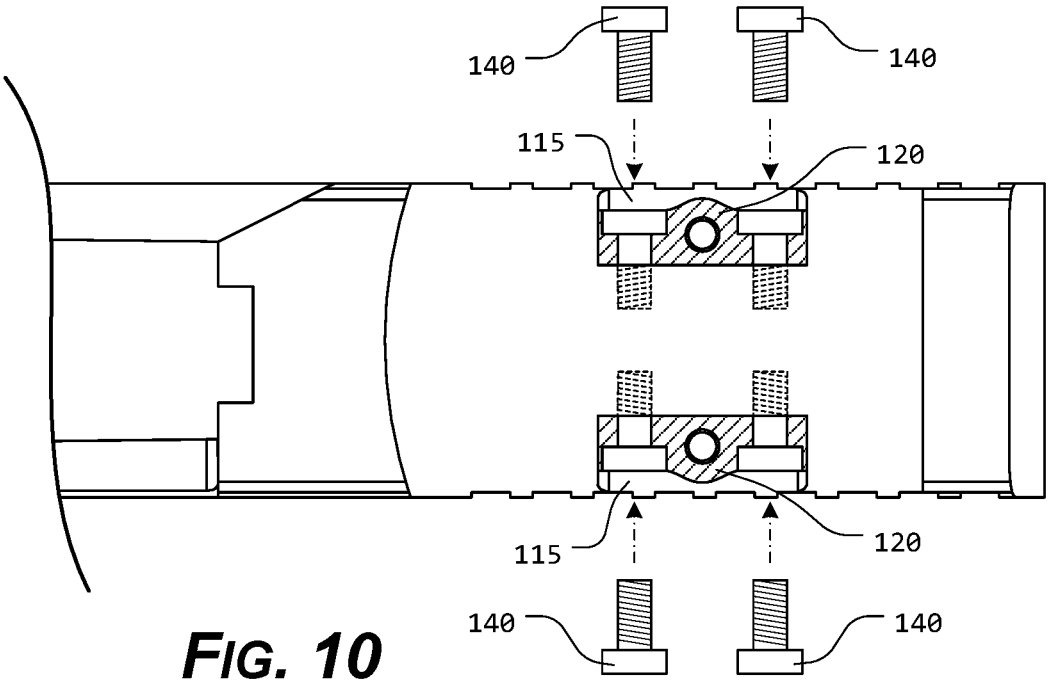
FIG. 10 illustrates a top view, wherein exemplary slide inserts are positioned within exemplary slide insert recesses and exemplary slide insert fasteners are aligned with corresponding exemplary insert fasteners apertures and slide insert recess apertures, according to the present disclosure.

As illustrated most clearly in FIGS. 7 and 9, a receiver pocket or slide insert recess 115 is milled into each side of the slide 100, within and below and area forming the slide optic recess 110. Generally, the slide insert recesses 115 are formed proximate an area where an attachment aperture of a desired optic will be positioned, when the optic is positioned within the slide optic recess 110. Each of the slide insert recesses 115 is formed so as to receive or at least partially receive a slide insert 120 therein.

In various exemplary embodiments, the slide insert recesses 115 are milled or formed so that the slide inserts 120 can be inserted substantially perpendicular to a longitudinal axis, $A_L$, of the slide 100.

One or more internally threaded slide insert recess apertures 117 are formed in each slide insert recess 115. Each slide insert recess aperture 117 is formed substantially perpendicular to a longitudinal axis, $A_L$, of the slide 100 and is formed so as to correspond to an insert fastener aperture 128 of a corresponding slide insert 120.

As illustrated most clearly in FIGS. 1-4 and 9, each slide insert 120 includes a generally cuboidal portion of material, having an outer side 121, an inner side 122, a top side 125, a bottom side 126, a right side 123, and a left side 124. As used herein, the terms "outer", "inner", "top", "bottom", "right", and "left" are used for reference only and are not to be viewed as limiting the present disclosure.

One or more, and typically two, insert fastener apertures 128 are formed through the slide insert 120, from the outer side 121 to the inner side 122. In various exemplary embodiments, the insert fastener apertures 128 are formed proximate the right side 123 and left side 124 of the slide insert 120. In certain exemplary embodiments, each insert fastener aperture 128 includes a counterbore 129 extending from the outer side 121 toward the inner side 122. In this manner, a slide insert fastener 140 can be inserted through each insert fastener aperture 128 and a head of each slide insert fastener 140 can be recessed within each corresponding counterbore 129.

In certain exemplary embodiments, a single insert fastener aperture 128, having a counterbore 129, is formed through the slide insert 120. In these exemplary embodiments, a single slide insert fastener 140 is utilized to attached or coupled the slide insert 120 within the slide insert recess 115.

In certain exemplary embodiments, 4 of the corners of the slide insert 120 are radiused. For example, the corners formed between the top side 125 and right side 123, the top side 125 and left side 124, the bottom side 126 and right side 123, and the bottom side 126 and left side 124, when viewed from the outer side 121 may optionally be radiused. In these exemplary embodiments, 4 corresponding corners of the slide insert recesses 115 are also appropriately radiused to receive the corresponding corners of the slide insert 120. This is to ensure that there is a precision fit or lockup between the slide inserts 120 and the slide insert recesses 115, when a directional force is applied to the slide insert 120.

At least one internally threaded optic fastener aperture 132 is formed through a top side 125 of each slide insert 120. The internally threaded optic fastener aperture 132 is formed so as to receive a at least a portion of the optic fastener therein to attach or couple an optic to the slide insert 120. In certain exemplary embodiments, an alignment boss 130 extends from a portion of the top side 125 of the slide insert 120. If included, the alignment boss 130 is formed so as to extend above a planar surface of the slide optic recess 110 and be aligned with a corresponding recess of the optic to further align the optic and the slide insert 120 and to assist in preventing movement of the optic relative to the slide insert 120.

In certain exemplary embodiments, the radii on the slide insert recesses 115 are milled with a tolerance of approximately 0.0025" so that the fit between the slide insert recess 115 and the slide insert 120 is effectively an interference fit.

In various exemplary embodiments, the slide inserts 120 are substantially rigid and are formed of steel. Alternate materials of construction of the slide inserts 120 may include one or more of the following: stainless steel, aluminum, titanium, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form the various components of the slide inserts 120 is a design choice based on the desired appearance and functionality of the slide inserts 120.

It is to be distinctly understood that each slide insert 120 (and a corresponding slide insert recess 115) may have any desired cross-sectional shape. Thus, while a substantially cuboidal outer shape would allow for ease in manufacturing, the shape of the slide inserts 120 is not limited to being substantially cuboidal and, for example, may have a substantially oval, oblong, triangular, square, rectangular, hexagonal, octagonal, or other geometrically non-geometric shape. The overall shape of each slide insert 120 is chosen so as to be positionable and maintained at least partially within an appropriate, corresponding slide insert recess 115.

It should also be understood that the overall size and shape of the slide inserts 120 (and corresponding slide insert recesses 115) and the various portions thereof is a design choice based upon the desired functionality and/or appearance of the slide inserts 120.

In order to attach or couple an optic, using the optic mounting system of the present disclosure, a slide 100 is provided with an appropriate slide optic recess 110 and appropriate slide insert recesses 115. A slide insert 120 is inserted into each of the slide insert recesses 115 formed in each side of the slide 100. Each slide insert 120 is inserted into a corresponding slide insert recess 115 such that an inner side 122 of the slide insert 120 contacts a surface of the slide insert recess 115 and at least a portion of the left side 124, right side 123, and bottom side 126 contact corresponding side portions of the slide insert recess 115. In certain exemplary embodiments, at least a portion of the rounded corners between the top side 125 and the right side 123 and/or left side 124 also contact corresponding side portions of the slide insert recess 115. In still other exemplary embodiments, at least a portion of the top side 125 of the slide insert 120 contacts one or more corresponding portions of the slide insert recess 115.

When each slide insert 120 is appropriately positioned within a slide insert recess 115, in addition to the interference fit between the slide insert recess 115 and the slide insert 120, a screw or slide insert fastener 140 is positioned through an aligned insert fastener aperture 128 and slide insert recess aperture 117. Each slide insert fastener 140 is urged through the insert fastener aperture 128, toward the slide insert recess aperture 117 until at least a portion of the external threads of the slide insert fastener 140 are able to interact with at least a portion of the internal threads of the slide insert recess aperture 117.

Interaction of the external threads of the slide insert fastener 140 and the internal threads of the slide insert recess aperture 117 allow the slide insert 120 to be threadedly attached or coupled to the slide 100, within the slide insert recess 115.

When each slide insert 120 is appropriately attached or coupled within at least a portion of each slide insert recess 115, the slide inserts 120 are positioned so that the internally threaded optic fastener apertures 132 can be accurately formed through the top side 125 (and optionally the alignment boss 130) of the slide insert 120. While forming of the internally threaded optic fastener apertures 132 may be performed with the slide inserts 120 appropriately attached or coupled within at least a portion of each slide insert recess 115, it should be appreciated that the internally threaded optic fastener apertures 132 may be formed in the slide inserts 120 prior to the slide inserts 120 being attached or coupled within the slide insert recesses 115.

In certain exemplary embodiments, the slide insert fasteners 140 comprise screws with 6-32 thread pattern and a low profile head using an allen key head design. Additionally, the internally threaded optic fastener aperture 132 may also be internally threaded with a 6-32 thread pattern and incorporate an alignment boss 130 at the top of the optic fastener aperture 132 to provide more thread contact as well as slide insert 120 into the optic's base and provide a more solid index assuring good zero of the optic during use.

Once the slide inserts 120 are appropriately inserted into the slide insert recesses 115, the slide 100 may optionally be milled one more time with the slide inserts 120 in place. During this milling procedure, if included, the slide inserts 120, which have effectively added width to the slide 100 at the optic's mounting points, are drilled, tapped, and fitted flush to the floor of the slide optic recess 110 for a matched fit and finish.

Figure 5:
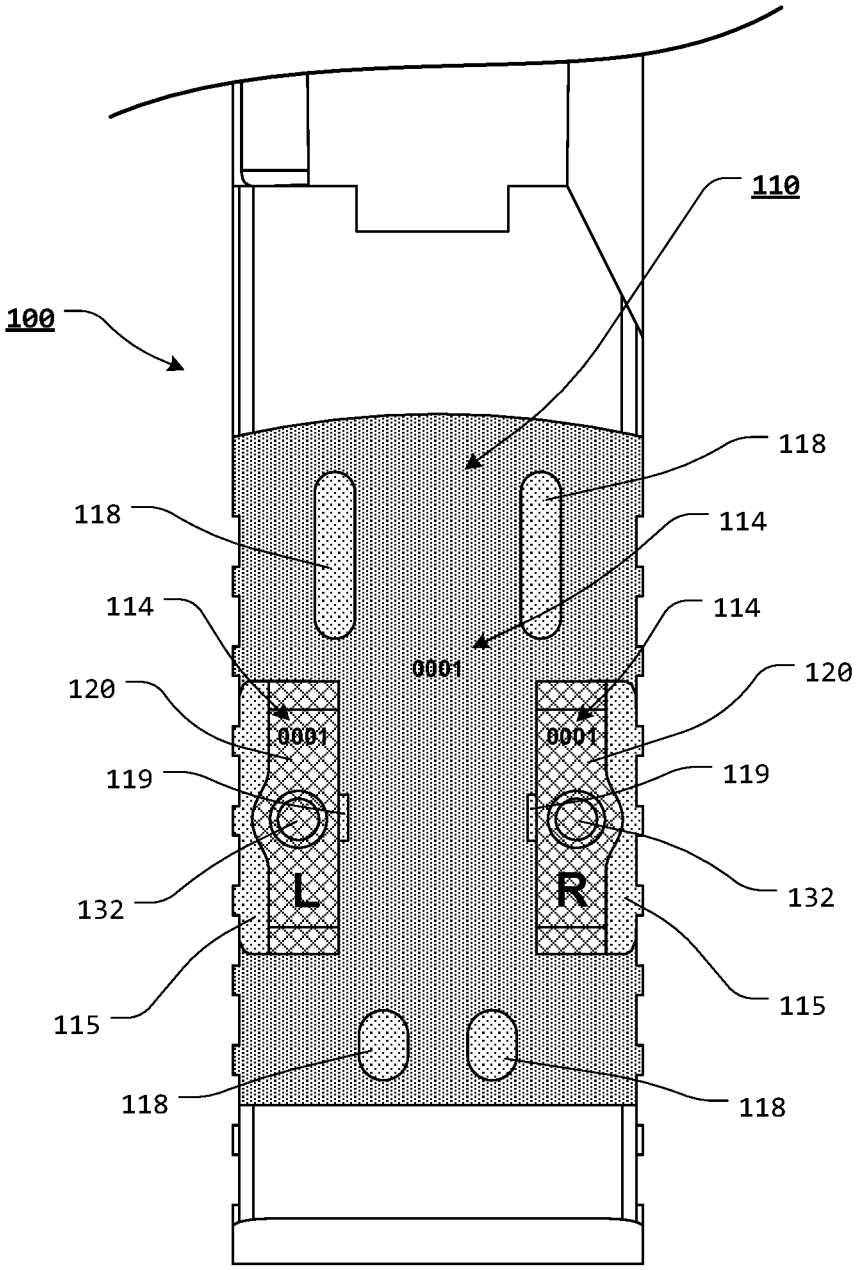
FIG. 5 illustrates a top view of an exemplary embodiment of a slide having a slide optic recess formed therein, according to the present disclosure.
Figure 6:
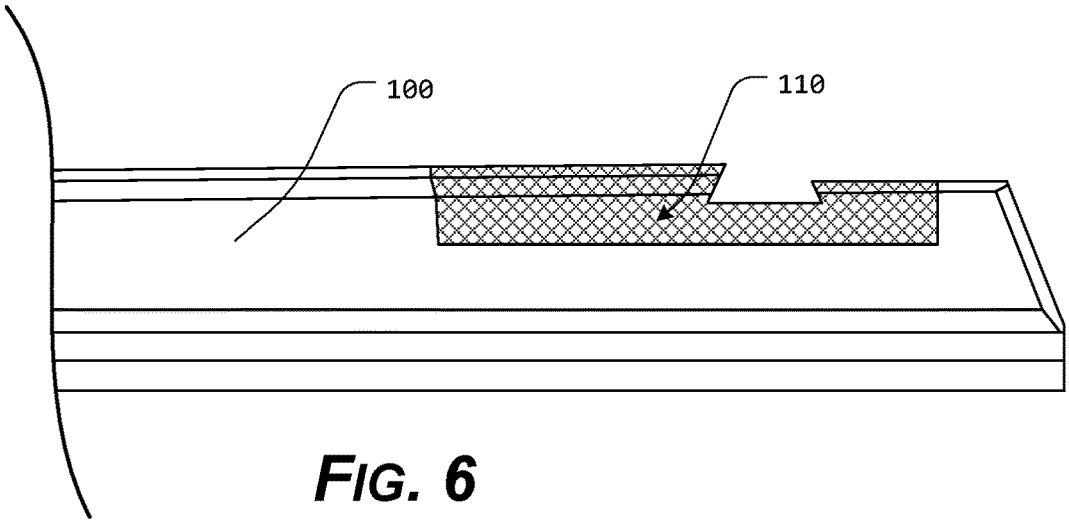
FIG. 6 illustrates a side view of an exemplary embodiment of a slide having a slide optic recess formed therein, according to the present disclosure.

As illustrated in FIG. 5, the slide inserts 120 are appropriately positioned within the slide inserts 120 on the left and right of the slide 100. Because a final milling operation was performed after placement of the slide inserts 120 within the slide insert recesses 115, the border between the slide inserts 120 and the slide 100 may be difficult to distinguish, as the machining has created a uniform surface for the optic to sit on. The two slide inserts 120 have now been drilled and tapped and may optionally be etched or laser engraved with certain identifying indicia 114, such as "L" and "R" and/or serial numbers so that the slide inserts 120 may optionally be removed and replaced within the appropriate slide insert recesses 115.

Exemplary elongate recess cuts 118 are optionally added as weight reduction cuts in the pistol slide 100, itself.

In certain exemplary embodiments, removal tool recesses 119 may be formed in one or more walls of the slide insert recesses 115 to allow a screw driver or other instrument to be inserted between a surface of the slide insert 120 and a surface of the slide insert recess 115 to allow the screwdriver or other instrument to be used to pry the slide inserts 120 out of their respective slide insert recesses 115.

As illustrated in FIG. 5, identifying indicia 114 has been laser engraved in the slide optic recess 110 of the slide 100 and the two slide inserts 120 to assure the slide inserts 120 can be match to the parent slide 100 after separation for coating or other finishing.

Figure 11:
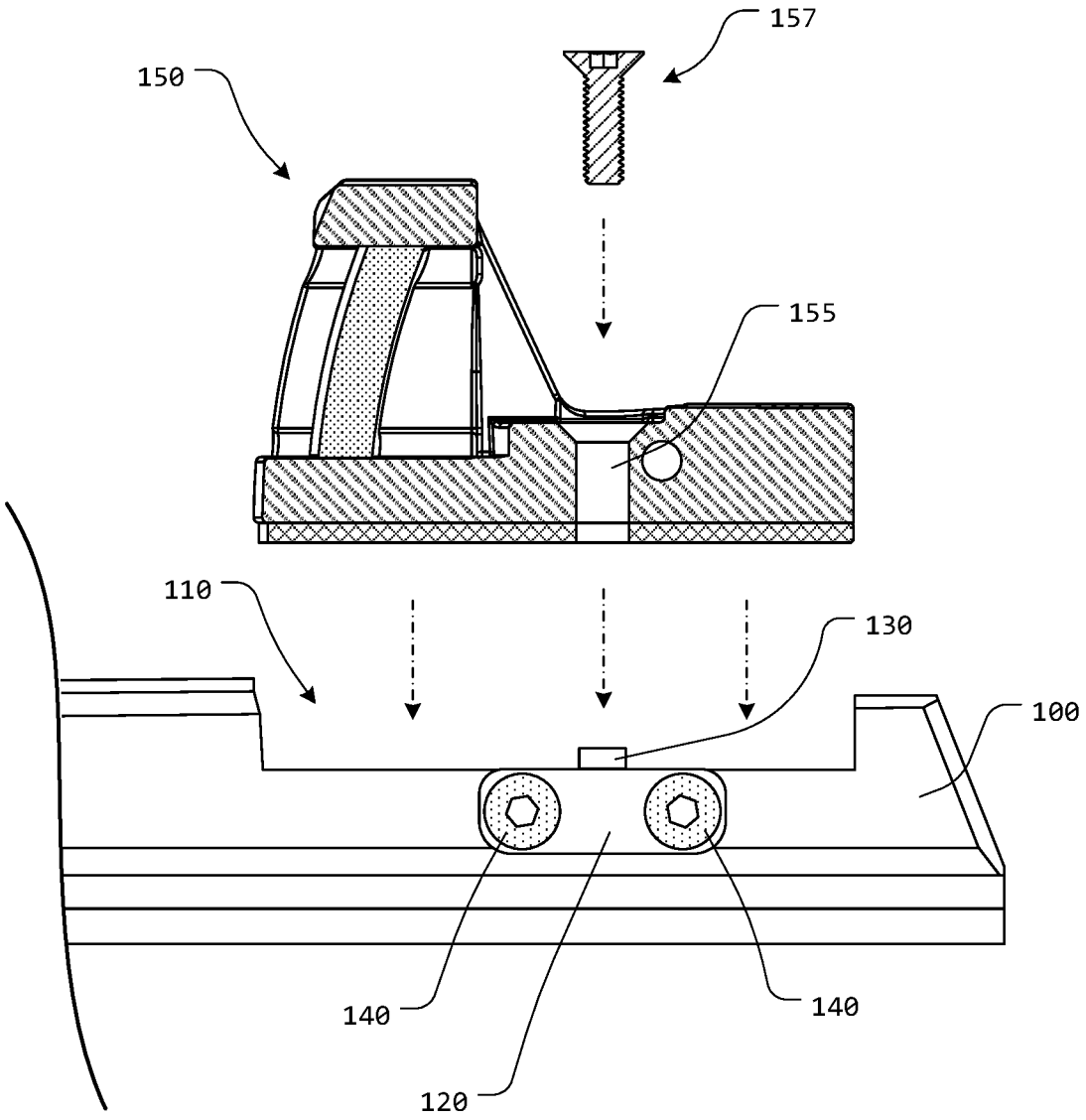
FIG. 11 illustrates a side, partial cutaway view of an exemplary optic being aligned with an exemplary slide optic recess, according to the present disclosure.
Figure 12:
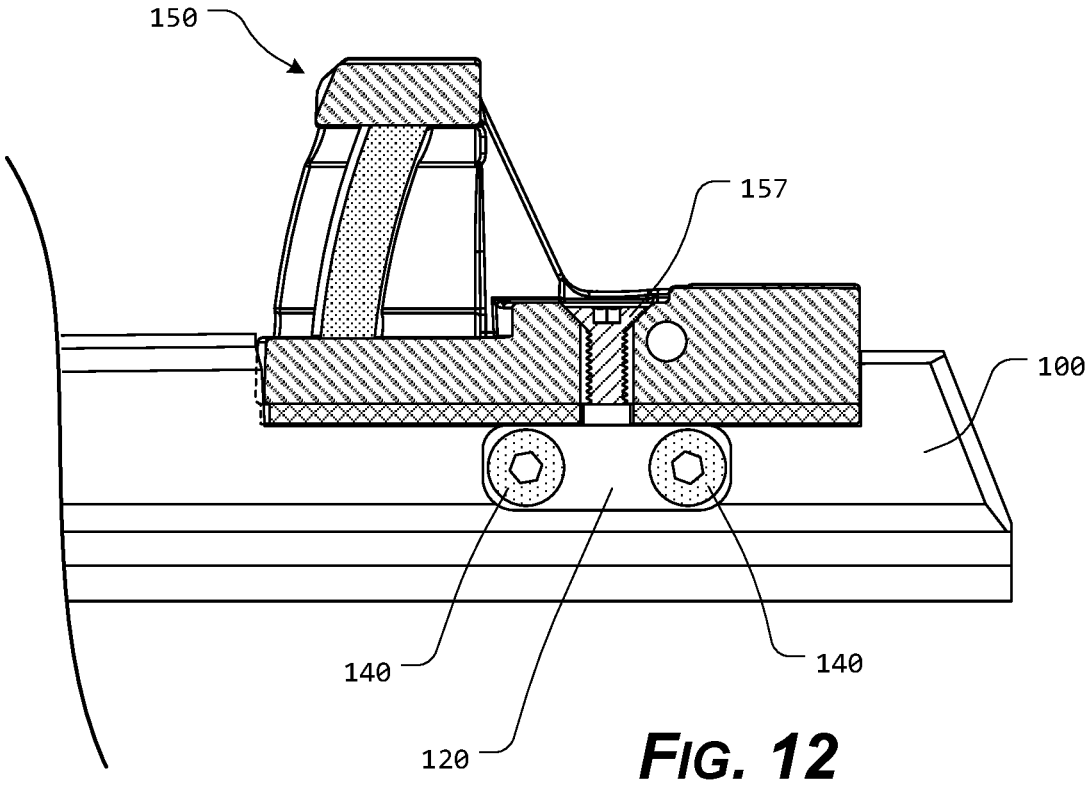
FIG. 12 illustrates a side, partial cutaway view of an exemplary optic attached or coupled within an exemplary slide optic recess, according to the present disclosure.
Figure 13:
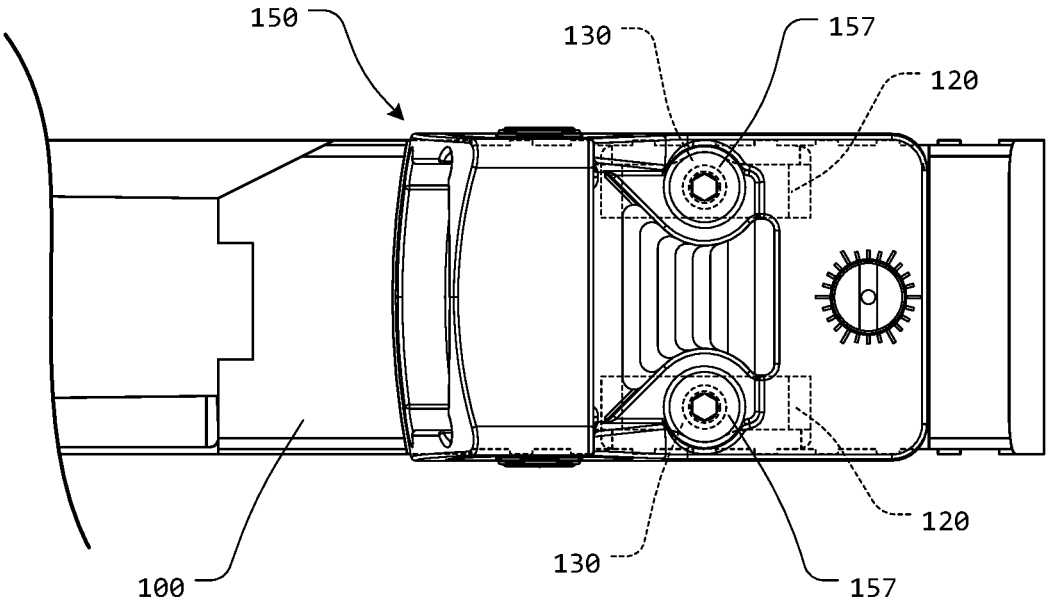
FIG. 13 illustrates a top view of an exemplary optic attached or coupled within an exemplary slide optic recess, according to the present disclosure.

As illustrated in FIGS. 11-13, once the slide inserts 120 are appropriately positioned, the base of an exemplary optic 150 is aligned within at least a portion of the slide optic recess 110. Additionally, the alignment boss 130 of each side insert 120 is aligned with an attachment aperture 155 of the optic 150. As the optic 150 is urged within at least a portion of the slide optic recess 110, the optic fastener apertures 132 (and optional alignment bosses 130) are aligned such that appropriate optic fasteners 157 interact with the optic fastener apertures 132 of the slide inserts 120 to further attach or couple the optic 150 within the slide optic recess 110 of the slide 100. As illustrated in FIGS. 12-13, the slide inserts 120 are in place and the optic 150 is mounted to the slide 100 at a relatively low position relative to the bore axis of the slide.

While the present disclosure has been described in conjunction with the exemplary embodiments outlined above, the foregoing description of exemplary embodiments, as set forth above, are intended to be illustrative, not limiting and the disclosure should not be considered to be necessarily so constrained. It is evident that the present disclosure is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the present disclosure. The upper and lower limits of these smaller ranges may independently be included in the smaller ranges and is also encompassed within the present disclosure, subject to any specifically excluded limit in the stated range. Where the stated range includes one or both of the limits, ranges excluding either or both of those included limits are also included in the present disclosure.

It is to be understood that the phraseology of terminology employed herein is for the purpose of description and not of limitation. Unless defined otherwise, all technical and scientific terms used herein have the same meaning as commonly understood by one of ordinary skill in the art to which the present disclosure belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the present disclosure, such that others may, by applying current knowledge, change, vary, modify, and/or adapt these exemplary, non-limiting embodiments for various applications without departing from the spirit and scope of the present disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the present disclosure.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. An optic mounting system, comprising:

a slide having a slide optic recess formed therein;

a pair of slide insert recesses formed in opposing sides of said slide, wherein each slide insert recess is formed at least partially below said slide optic recess, wherein one or more internally threaded slide insert recess apertures is formed in each slide insert recess; and a pair of slide inserts, wherein each slide insert is positioned within a corresponding slide insert recess, wherein at least one insert fastener aperture is formed through each said slide insert, wherein each insert fastener aperture is positioned so as to be aligned with an internally threaded slide insert recess aperture, and wherein at least one internally threaded optic fastener aperture is formed through a top side of each slide insert.

2. The optic mounting system of claim 1, wherein said slide optic recess is formed so as to allow a desired optic to be attached, coupled, or otherwise mounted within at least a portion of said slide optic recess.

3. The optic mounting system of claim 1, wherein an alignment boss extends from a portion of the top side of each said slide insert around at least a portion of each optic fastener aperture, and wherein said alignment bosses extend above at least a portion of said slide optic recess.

4. The optic mounting system of claim 3, wherein each alignment boss extends above a planar surface of said slide optic recess.

5. The optic mounting system of claim 1, wherein each slide insert recess aperture is formed substantially perpendicular to a longitudinal axis of said slide.

6. The optic mounting system of claim 1, wherein each slide insert is substantially cuboidal, when viewed from an outer side of the said slide insert.

7. The optic mounting system of claim 1, wherein each slide insert is substantially oval, oblong, triangular, square, rectangular, hexagonal, or octagonal, when viewed from an outer side of the said slide insert.

8. The optic mounting system of claim 1, wherein each insert fastener aperture includes a counterbore.

9. The optic mounting system of claim 1, wherein at least 4 corners of said slide inserts are radiused and wherein 4 corresponding corners of said slide insert recesses are appropriately radiused to receive said corresponding corners of said slide insert.

10. The optic mounting system of claim 1, wherein a fit between portions of said slide insert recess and portions of said slide insert is an interference fit.

11. An optic mounting system, comprising:

a slide having a slide optic recess formed therein, wherein said slide optic recess extends from a top side of said slide;

slide insert recesses formed in opposing side portions of said slide, wherein each slide insert recess is formed at least partially below said slide optic recess, wherein one or more internally threaded slide insert recess apertures is formed in each slide insert recess; and a pair of slide inserts, wherein each slide insert is positioned within a corresponding slide insert recess, wherein at least one insert fastener aperture is formed through each said slide insert, wherein each insert fastener aperture is positioned so as to be aligned with an internally threaded slide insert recess aperture, wherein at least one internally threaded optic fastener aperture is formed through a top side of each slide insert, wherein an alignment boss extends from a portion of the top side of each said slide insert around at least a portion of each optic fastener aperture, and wherein said alignment bosses extend above at least a portion of said slide optic recess.

12. The optic mounting system of claim 11, wherein said slide optic recess is formed so as to allow a desired optic to be attached, coupled, or otherwise mounted within at least a portion of said slide optic recess.

13. The optic mounting system of claim 11, wherein each slide insert recess aperture is formed substantially perpendicular to a longitudinal axis of said slide.

14. The optic mounting system of claim 11, wherein each slide insert is substantially cuboidal, when viewed from an outer side of the said slide insert.

15. The optic mounting system of claim 11, wherein each insert fastener aperture includes a counterbore.

16. The optic mounting system of claim 11, wherein each alignment boss extends above a planar surface of said slide optic recess.

17. The optic mounting system of claim 11, wherein a fit between portions of said slide insert recess and portions of said slide insert is an interference fit.

18. An optic mounting system, comprising:

a slide having a slide optic recess formed therein, wherein said slide optic recess extends from a top side of said slide and includes a substantially planar surface;

slide insert recesses formed in opposing side portions of said slide, wherein each slide insert recess is formed at least partially below said slide optic recess; and a slide insert positioned within each slide insert recess, wherein at least one internally threaded optic fastener aperture is formed through a top side of each slide insert, wherein an alignment boss extends from a portion of the top side of each said slide insert around at least a portion of each optic fastener aperture, and wherein said alignment bosses extend above at least a portion of said slide optic recess.

19. The optic mounting system of claim 18, wherein each alignment boss extends above said substantially planar surface of said slide optic recess.

20. The optic mounting system of claim 18, wherein a fit between portions of said slide insert recess and portions of said slide insert is an interference fit.

* * * * *